United States Patent [19]

Giebel

[11] Patent Number: 4,558,478

[45] Date of Patent: Dec. 17, 1985

[54] DEVICE FOR TENSIONING A SHOE UPPER ON A LAST AND FOR LAYING ITS LASTING MARGIN OVER IN THE BALL AND SHANK REGION

[75] Inventor: Gerhard Giebel, Bad Soden, Fed. Rep. of Germany

[73] Assignee: USM Corporation, Farmington, Conn.

[21] Appl. No.: 597,450

[22] Filed: Apr. 6, 1984

[51] Int. Cl.[4] ..... A43D 21/12

[52] U.S. Cl. ..... 12/81; 12/143; 12/12

[58] Field of Search ..... 12/8.1, 8.2, 14.3, 14.4, 12/53.5

[56] References Cited

U.S. PATENT DOCUMENTS

| | | | |
|---|---|---|---|
| 182,560 | 9/1876 | Copeland | 12/8.1 |
| 302,885 | 8/1884 | Brock | 12/8.1 |
| 422,734 | 3/1890 | Copeland et al. | 12/8.1 |
| 2,050,377 | 8/1936 | Pym | 12/8.1 |
| 2,222,212 | 11/1940 | Lancaster | 12/8.1 |
| 3,678,522 | 7/1972 | Bumbatek et al. | 12/8.1 |
| 4,167,052 | 9/1979 | Schindler | 12/8.1 |

FOREIGN PATENT DOCUMENTS

| | | | |
|---|---|---|---|
| 2525087 | 10/1983 | France | 12/8.1 |

*Primary Examiner*—Henry S. Jaudon
*Assistant Examiner*—Steven N. Meyers
*Attorney, Agent, or Firm*—Donald N. Halgren

[57] ABSTRACT

Device for tensioning a shoe upper on a last and for laying its lasting margin over in the ball and shank region, wherein the shoe upper is first pressed against the last by means of a presser member, whereafter a band secured to the presser member is tensioned about the shoe upper in a direction towards the last bottom. The bands which embrace the last from both sides are brought together in tension in the middle of the insole.

7 Claims, 6 Drawing Figures

DEVICE FOR TENSIONING A SHOE UPPER ON A LAST AND FOR LAYING ITS LASTING MARGIN OVER IN THE BALL AND SHANK REGION

BACKGROUND OF THE INVENTION

1. Field of the Invention

This invention relates to a device for tensioning a shoe upper on a last and for laying its lasting margin over in the ball and shank region, wherein the shoe upper is pressed against the last by presser members by which pressure is applied to each side of the last, wherein there is fixed to each presser member a band which faces the shoe upper with its engaging surface and which, when the presser member lies adjacent the last, is drawn in the direction of the insole edge and about said edge in such a manner that the two bands meet substantially in the middle of the last bottom.

2. Description of Prior Art

Such a device is known from DE-OS No. 2650680. It serves to bring the shoe upper in the ball and shank region into a position suitable for a subsequent toe and side lasting operation and to hold the upper in this position during the lasting operation. In such a device the bands are drawn about the insole edge in such a way that they cross substantially in the middle of the last bottom and terminate in drafting elements which lie on the other side of the last in relation to the respective presser member, each band, beyond the cross-over position, being drawn, in a direction towards the drafting element, at a slight distance over that lasting margin about which the other band has been drawn. This distance must be maintained and thus a touching contact with the lasting margin at this position be avoided, because otherwise upon tensioning the band and its elastic yielding this lasting margin would be drawn downwardly away from the insole by the band in question. This distance, which has necessarily to be maintained, means that the band is increasingly distanced from that lasting margin about which it is drawn, in particular in a direction from the insole edge to the drafting element, so that an intensive application of pressure can arise only at the insole edge. Further inwardly, the pressure applied by the band to the lasting margin increasingly decreases. Furthermore, the crossing over of the bands leads to a certain displacement of the bands in relation to the longitudinal direction of the shoe, which shows inself noticeably undesired when, in use, there is a transition from a right to a left shoe or vice versa, since in this transition, even if a certain displacement is desired in relation to the one shoe, with the other shoe it appears in an undesired manner in the reverse direction. Finally in the known device it is to be noted that by the drafting force on the two bands which cross over, the insole of the shoe to be treated is not compressed. This tendency is furthered in that, because of the position of the bands, the shoe upper is tensioned in a direction towards the insole edge when the drafting effect is instituted and at the same time the lasting margin is drawn inwardly at least in the region of the insole edge.

BRIEF SUMMARY OF THE INVENTION

The invention is based on the object of improving the known device with respect to its mode of operation on the shoe upper and the lasting margin and to avoid problems which arise because of the displacement. In accordance with the invention this takes place in that the two bands are held, in tensionable condition adjacent to one another with their engaging surfaces substantially facing one another, by guides which lie opposite the central region of the insole and determine the direction in which tension is applied, said bands being movable together over the last bottom between the insole edges by means of pusher elements.

In this device the cross-over of the bands is avoided. They are held substantially in a position in which their engaging surfaces come together. In this way it is possible to tension the bands first, so that they first tension only the shoe upper, because of the guides which determine the direction in which the tension is applied, without at the same time exerting a substantial influence on the lasting margin. Thereafter it comes advantageously about, that the compression of the bands, achieved by means of the pusher elements, lays the bands continuously about the insole edge so that a combined effect in relation to the insole edge is achieved, namely the laying over with simultaneous tensioning thereof, whereby the tendency to compress the insole is countered.

The bands can be secured, at their ends facing away from the presser members, in holders which are movable to-and-fro in relation to the insole. By these holders the necessary tension is applied to the bands. Advantageously the holders are able to combine to form a clamp which lies opposite the insole. By a movement of the holders or clamp away from the last bottom the bands are then provided with the necessary tension and, by virtue of the friction of their engaging surface against the shoe upper, move the latter therewith and thus tension it.

The pusher elements are suitably formed as parallel closely adjacent rolls between which the two bands are guided and which are carried by a lift mechanism which moves the rolls substantially perpendicularly to the insole, more particularly between a first end position, in which the rolls, which at the same time form the guides, are held at a distance from the insole, and a second end position, in which the rolls progressively bring together the two bands on the insole. By the rolls two effects are thus achieved. On the one hand, in the first end position they serve as guides to hold the bands first in their adjacent position with their engaging surfaces substantially facing one another, whereafter by moving the rolls in the direction towards the shoe bottom, that is to say from the first end position into the second end position, the rolls increasingly draw the two bands together and finally urge them together on the last bottom, the rolls thus acting as the pusher elements. With this transition from the first into the second end position the bands are continuously laid over the insole edge and thus the lasting margin is increasingly tensioned, since the two bands, as they move together, move the lasting margins therewith because of the friction applied by the engaging surface of the bands. In this regard, the two rolls can advantageously be caused to press against the insole in the second end position, so that additionally a pressure effect still arises also.

An especially intensive effect of the bands is achieved if they consist of stretchable material at least in the region thereof extending from the presser member up to the insole edge. In this case the stretchability of the bands is concentrated in the region in which they have to exercise above all a tensioning effect. With the stretching of the appropriate part of the band the region of the band which is in contact with the lasting margin thus is automatically moved so that a tensioning effect is exercised also on the lasting margin.

In order that the two rolls have, with regard to their axial direction in relation to the longitudinal axis of the shoe to be treated, a certain facility for accommodation, the two rolls can be mounted for pivotal movement on a common axis which extends substantially perpendicularly to the insole. In this case the two rolls can accommodate to a longitudinal axis of a shoe, which axis may be somewhat inclined.

The pusher elements are advantageously journalled for tilting movement to accommodate to the spring of the shoe. In this way it is provided that the pusher elements always assume a position, as it is determined by the spring of the shoe.

BRIEF DESCRIPTION OF THE DRAWINGS

In the drawings are illustrated exemplary emobodiments of the invention.

DESCRIPTION OF THE PREFERRED EMBODIMENTS

Figure 1:
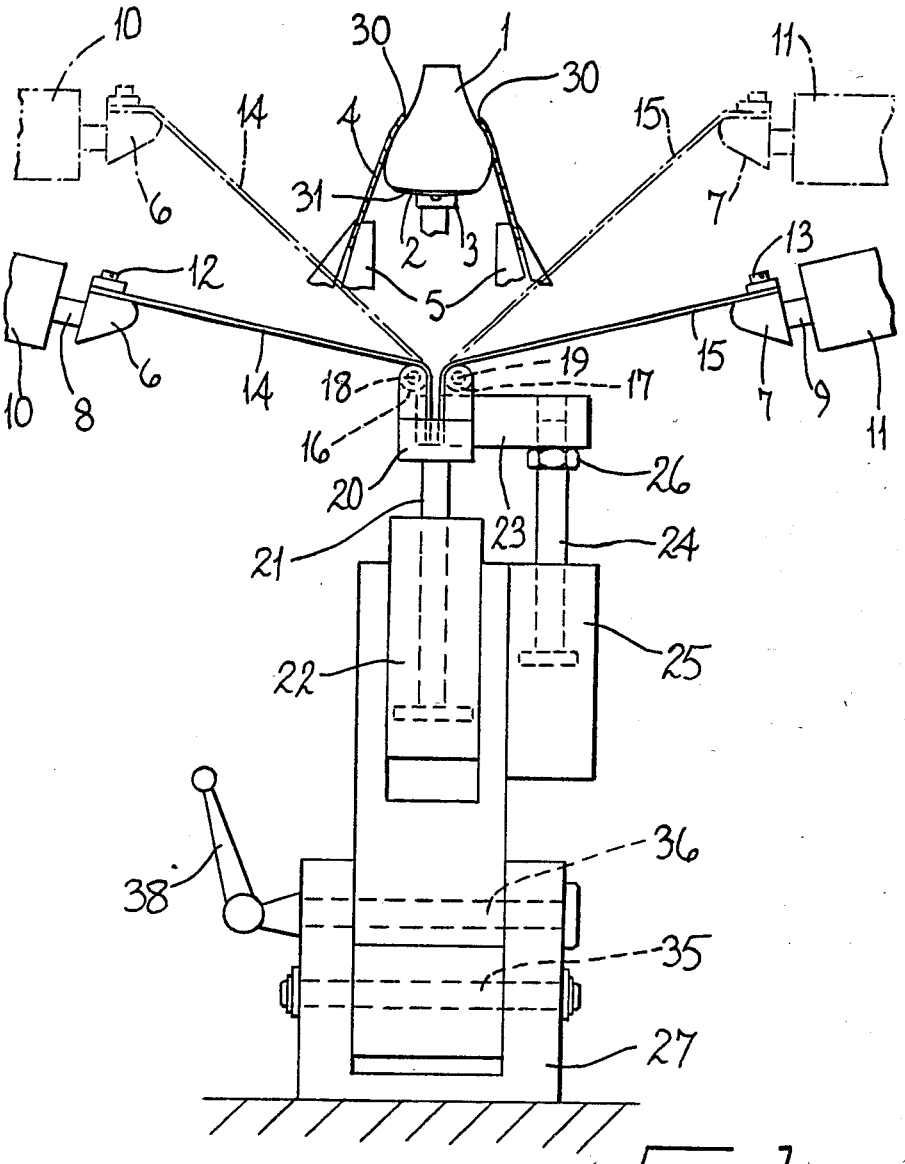
FIG. 1 shows the device with two rolls, acting as guides and pressure elements, in the first end position, the presser members being first held at a distance from the last.

FIG. 1 shows the last 1 with insole 2, which rests on the last support 3. On the last 1 is drawn the upper 4 which is pulled over in known manner by the pincers 5.

In a manner which is known but not illustrated, the two presser members 6 and 7 are held laterally of the last 1, in particular at the end of piston rods 8 and 9 of the piston-and-cylinder units 10 and 11. On the two presser members 6 and 7 are secured, by means of screws 12 and 13, the two bands 14 and 15 which run to the two rolls 16 and 17 which in turn are journalled for pivotal movement on the two axes 18 and 19. The two rolls 16 and 17 are mounted on the bifurcated member 20 which is secured at the end of the piston rod 21, which is a component of the piston-and-cylinder unit 22. With the aid of this piston-and-cylinder unit 22 the bifurcated member 20, and thus the two rolls 16 and 17, can be moved towards and away from the last 1 in a perpendicular direction in relation to the insole 2. The two bands 14 and 15 are brought together behind the two rolls 16 and 17 in the clamp 23 which is mounted at the end of the piston rod 24 of the piston-and-cylinder unit 25. The clamp 23 is secured, adjustably in different positions, by means of the counter-nut 26 in respect of its position in relation to the piston rod 24. When the piston rod 24 is drawn into the piston-and-cylinder unit 25 the clamp 23 is moved therewith and thus places the two bands 14 and 15 under tension. Further details of the mode of operation of the bearing 27 for the piston-and-cylinder unit 22 is set out further below in connection with the explanation of FIG. 4.

Hereinafter the mode of operation of the device illustrated in FIG. 1 is now to be explained: in order to tension the shoe upper 4 by means of the bands 14 and 15 and to lay its lasting margin 28 and 29 about the edge 31 of the insole 2, the presser members 6 and 7 together with their piston-and-cylinder units 10 and 11 are brought, by means not of interest in this connection, into the position illustrated in chain-dot line in FIG. 1, from which they are moved in a direction towards the last 1 until they reach the position shown in FIG. 2. The presser members 6 and 7 thus engage each side of the last 1, pressing the shoe upper 4 against the last, with the bands 14 and 15 lying therebetween. By means of the presser members 6 and 7 it is ensured that, upon the later tensioning of the shoe upper 4, the latter is firmly held against the last 1 in the region of its topline. In this operation the pincers 5 open and thus release the lasting margin 28 and 29.

Actuation of the piston-and-cylinder unit 25 now follows, drawing in its piston rod 24 and thus moving the clamp 23 therewith. The device now occupies its first end position. The clamp 23 applies a drafting force to the bands 14 and 15 which are thus tensioned and stretched in the region of the shoe upper 4. The two bands 14 and 15 consist of stretchable material, e.g. rubber, in the region of the shoe upper 4. The adjacent region of the bands 14 and 15, in a direction towards the clamp 23, can consist of flexible non-stretchable material. In this way, first the shoe upper 4 is tensioned over the last 1, without any special effect being exercised on the lasting margin 28 and 29 thereby.

Figure 2:
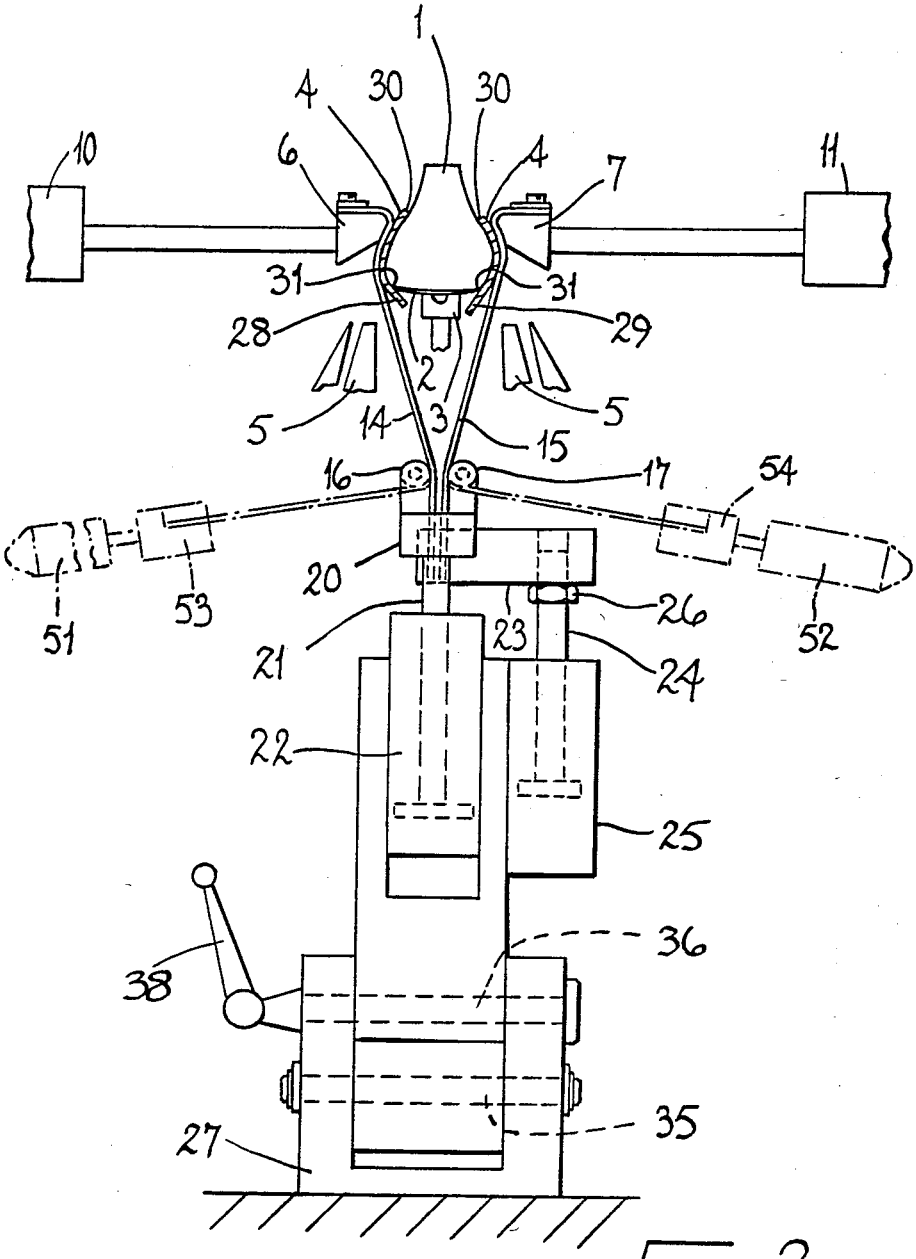
FIG. 2 shows the same device, also in the first end position, but with the presser members advanced against the last.

The drafting force on the bands 14, 15 can be effected also by means of the piston-and-cylinder units 51, 52, shown in chain-dot in FIG. 2, together with the tensioning elements 53, 54 in which the bands 14, 15 are clamped.

Figure 3:
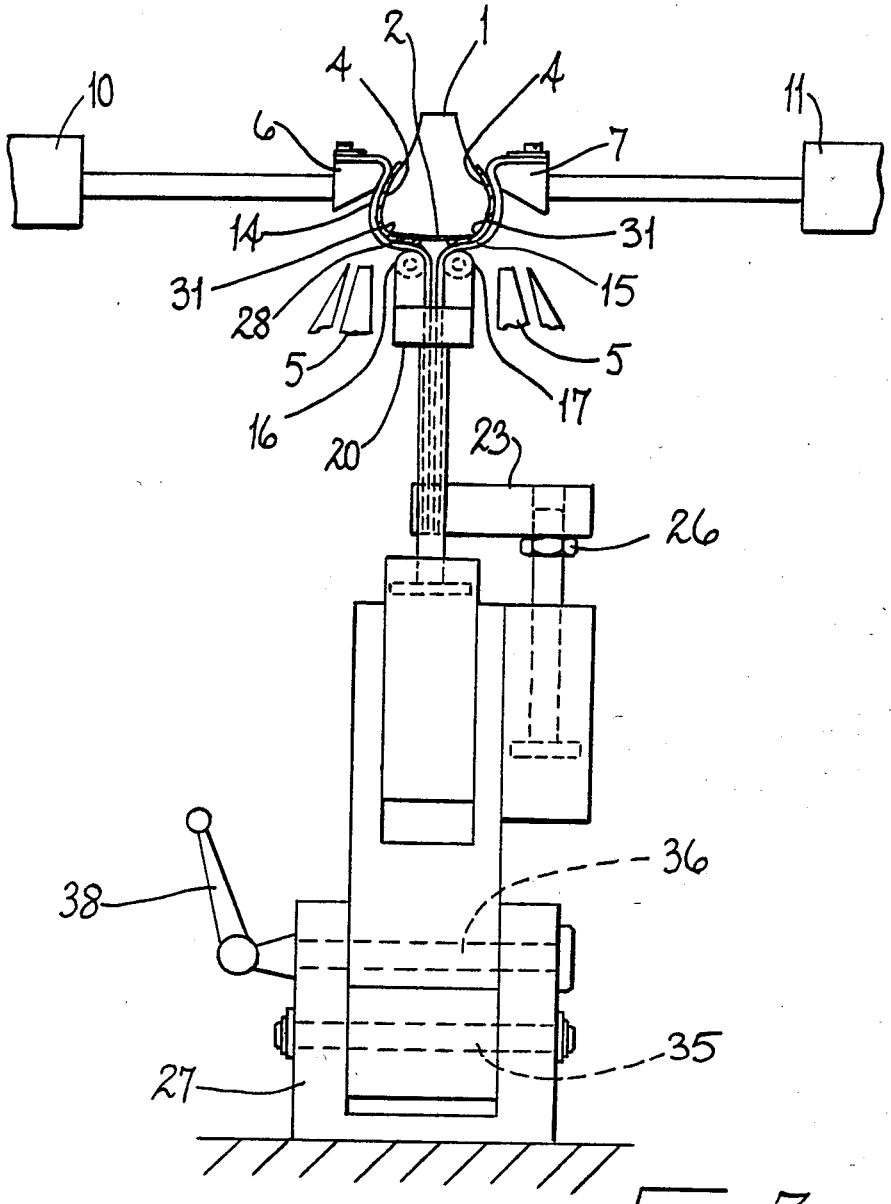
FIG. 3 shows the device of FIGS. 1 and 2 in the second end position, in which the rolls have drawn the two bands together on the last bottom.

Now follows an upward movement of the bifurcated element 20 with the two rolls 16 and 17 by the piston rod 21 being moved out of the piston-and-cylinder unit 22 into the position of the rolls 16 and 17, shown in FIG. 3. With this upward movement of the rolls 16 and 17 there arises for the bands 14 and 15 an extension of the portion from the last 1 to the clamp 23, which portion is to be run over by the rolls, so that the bands 14 and 15 are further stretched in their stretchable region. As a result of the movement of the rolls 16 and 17 the lasting margin 28 and 29 is simultaneously laid over the edge 31 of the insole, and more particularly with advancing tensioning of the lasting margin 28 and 29, the nearer the rolls 16 and 17 approach the insole 2. In this way, any tendency of the insole to be compressed thereby is by and large countered. In this position, shown in FIG. 3, which shows the second end position, a lasting operation can then take place in the region of the toe and the ball region of the shoe in question, the lasting operation being well prepared in the ball region by virtue of the tensioning of the shoe upper 4 and of the lasting margin 28 and 29 which has taken place, so that an especially good lasting result can be achieved in the ball region.

For treating a further last with an upper the bifurcated element 20 together with the rolls 16 and 17 is again returned and the presser member 6 and 7 brought back into the position shown in full line in FIG. 1. The clamp 23 moves heightwise and thereby relaxes the tension in the bands 14 and 15.

Figure 4:
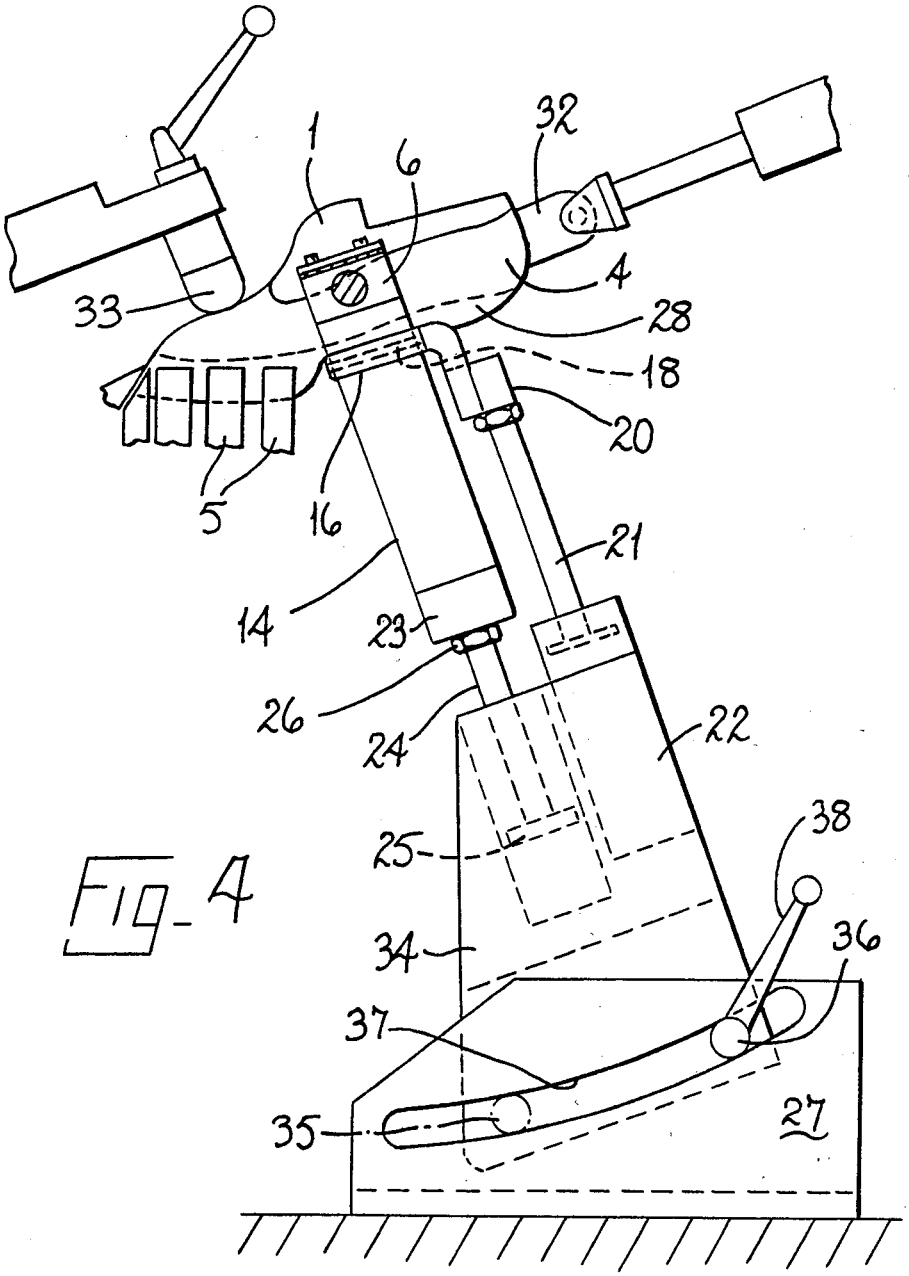
FIG. 4 shows a side view of the device of FIG. 3.

FIG. 4 shows, viewed from the side, the device illustrated in FIGS. 1 to 3, more particularly in the second end position, as also shown in FIG. 3. The last 1 with the shoe upper 4 is held with its heel end by means of the heel hold 32 and by the toe hold-down 33 (the last support 3 in accordance with FIGS. 1 and 2 is not shown here).

From FIG. 4 it is seen that the carrier 34 for the piston-and-cylinder units 22 and 25 is held in the bearing 27, more particularly by means of the two bolts 35 and 36 which can slide in the arcuately curved longitudinal slot 37. Screwed on the bolt 36, further, is the locking lever 38 by which the carrier 34 can be locked in known manner relative to the being 27 in any position of the carrier 34. By moving the carrier 34 relative to the bearing 27 appropriate adjustment of the two bands 14 and 15 in relation to the last 1 can be achieved, corresponding to the region of movement afforded by the longitudinal slot 37, thereby effecting a variation with respect to the angle of the bands, whereby the spring of the shoe to be treated can correspondingly be taken into account.

The piston rod 21 carrying the two rolls 16 and 17 forms for the two rolls 16 and 17 an axis which extends substantially perpendicularly to the last bottom or the insole 2, and which can turn in the piston-and-cylinder unit 22. In this way, the bifurcated element 20 together with the two rolls 16 and 17 can accommodate to a certain extent to right and left shoes.

Figure 5:
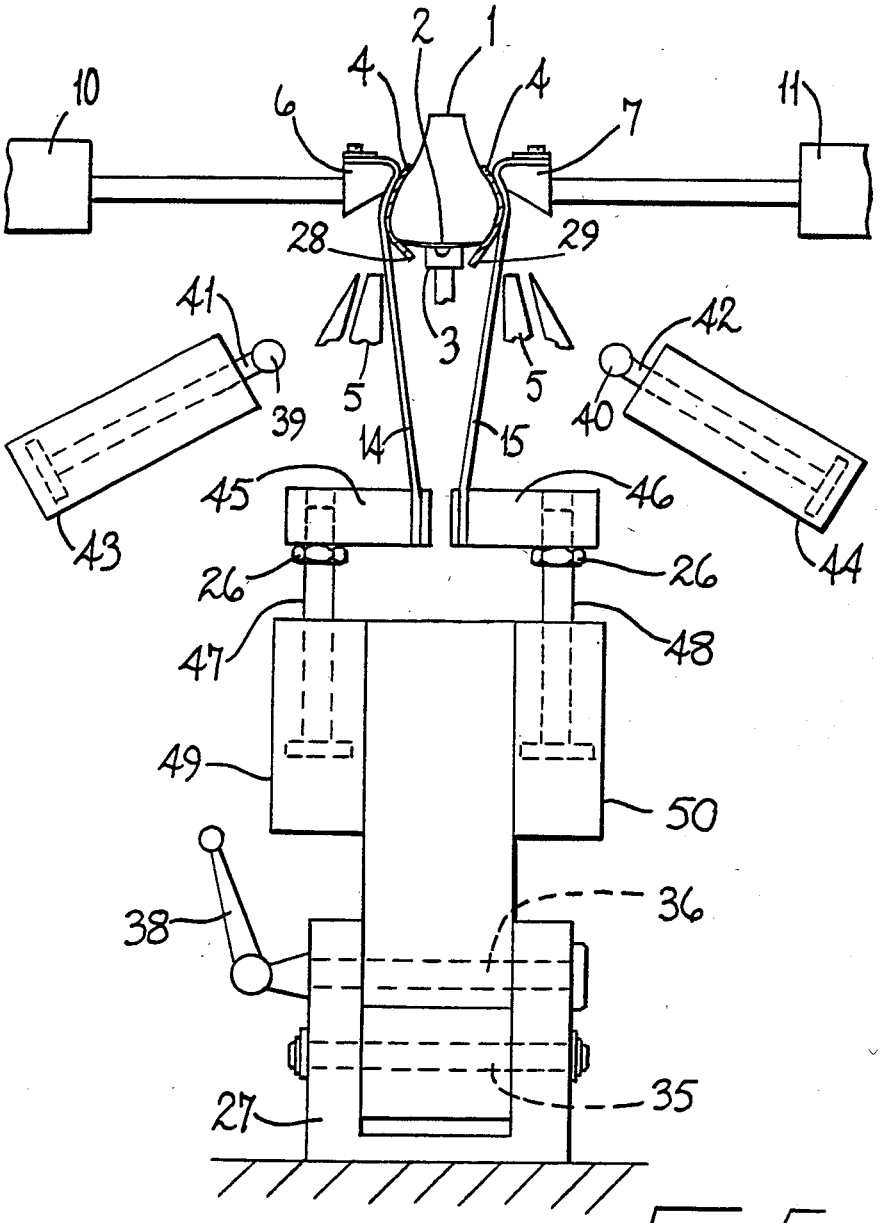
FIG. 5 shows a device similar to that in accordance with FIGS. 1 to 4, but with two separate pusher elements which can be moved against the last bottom, instead of the rolls.
Figure 6:
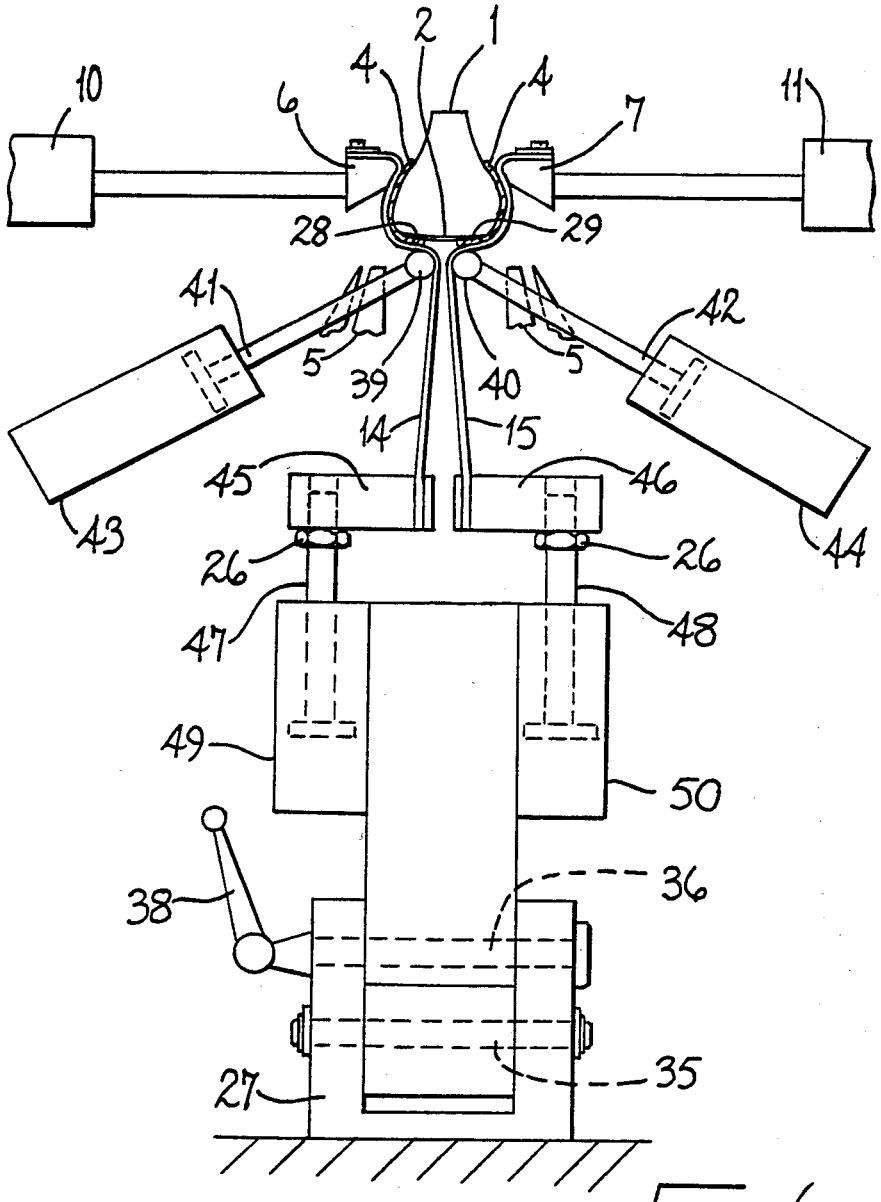
FIG. 6 shows the same device with the pusher elements moved against the last bottom.

In FIGS. 5 and 6 is shown a device wherein, instead of the rolls 16 and 17, the pusher elements 39 and 40 are provided. The pusher elements 39 and 40 are mounted at the end of the piston rods 41 and 42 of the piston-and-cylinder units 43 and 44, which, upon actuation, advance the pressure elements 39 and 40 in a direction towards the last 1. With regard to the operation of the presser members 6 and 7 and the bands 14 and 15, reference should be made to the explanation relating to FIGS. 1 and 4.

FIG. 5 shows the device in the first end position in which the bands 14 and 15 are pressed by the presser members 6 and 7 against the shoe upper 4, the bands 14 and 15 being in addition tensioned. To this end, the two holders 45 and 46 are provided, moveable to-and-fro in relation to the last 1 (see FIG. 5), the holders replacing here the common clamp 23 in accordance with FIGS. 1 and 4, so that a draft can be exercised by means of the holders 45 and 46 individually on each of the two bands 14 and 15. The two holders 45 and 46 are mounted on the ends of the two piston rods 47 and 48 of the appropriate piston-and-cylinder units 49 and 50. Their actuation takes place in a manner corresponding to that of the piston-and-cylinder unit 25 in accordance with FIGS. 1 to 3.

After the bands 14 and 15 have been tensioned, the pusher elements 39 and 40 are advanced, operating in a similar manner to the rolls 16 and 17. The pusher elements 39 and 40 finally assume the position shown in FIG. 6, which forms the second end position. In this position the pusher elements 39 and 40 press against the lasting margin 28 and 29, as in the manner of the rolls 16 and 17 in FIG. 3, and in principle the same laying over and tension effects with respect to the lasting margin 28 and 29 are achieved.

With regard to the arrangement of the individual elements of the afore-described device within a framework, it should be noted that it is a question here of known features, as are set out for example in DE-AS No. 2519974.

For reasons of clarity of the illustration, the corresponding details have not been drawn in this case, since they belong to the prior art.

We claim:

1. A lasting machine for tensioning a shoe upper on a last and for laying its lasting margin over in the ball and shank region comprising,
   - a pair of presser members each adapted to be displaced from a remote position to an operative position forcefully engaging a side surface of the last,
   - a pair of stretchable bands,
   - means for securing one end of each of said bands to its associated presser member,
   - first cylinder means including first rod means having means for clamping the other end of each of said bands, said first rod means being displaceable from a first position to a second position for stretching said bands, and
   - second cylinder means including second rod means having a pair of roller means, said second rod means being displaceable from a retracted position to an advanced position displacing said belts to a position adjacent the insole.

2. A lasting machine according to claim 1, wherein said rod means further comprises means for adjusting the position of said clamp means.

3. A lasting machine according to claim 1, wherein said roller means forcefully locates said bands against the insole when said roller means is at said advanced position.

4. A lasting machine according to claim 1, wherein said roller means are in continuous engagement with said bands.

5. A lasting machine according to claim 1, wherein said clamping means clamps said bands in adjacent face to face relation.

6. A lasting machine according to claim 5, wherein said first cylinder means comprises a pair of parallel cylinders.

7. A lasting machine according to claim 5, wherein said first and second rod means are parallel and said roller means are adjacent to said clamping means when said first rod means is at said first position and said second rod means is at said retracted position.

* * * * *